United States Patent [19]

Foust

[11] Patent Number: 4,524,472

[45] Date of Patent: Jun. 25, 1985

[54] COFFIN BED ADJUSTING APPARATUS

[76] Inventor: Robert K. Foust, 301 Mary Kay, Connersville, Ind. 47331

[21] Appl. No.: 526,170

[22] Filed: Aug. 25, 1983

Related U.S. Application Data

[63] Continuation-in-part of Ser. No. 405,993, Aug. 6, 1982, Pat. No. 4,404,716.

[51] Int. Cl.[3] ..... A61G 7/00

[52] U.S. Cl. ..... 5/62; 5/11; 27/12; 108/7; 248/188.4

[58] Field of Search ..... 248/188.4, 405, 650, 248/656; 108/7; 5/11, 62, 63–65, 509; 27/12

[56] References Cited

U.S. PATENT DOCUMENTS

| | | | |
|---|---|---|---|
| 2,839,814 | 6/1958 | Harter | 5/62 |
| 2,888,732 | 6/1959 | Nelson | 5/62 |
| 3,041,704 | 7/1962 | Gruber | 5/509 |
| 3,065,516 | 11/1962 | Dower | 5/62 |
| 3,692,267 | 9/1972 | Kronas et al. | 5/62 |
| 4,070,073 | 1/1978 | Peterson | 27/12 |
| 4,403,380 | 9/1983 | Hazelett et al. | 27/12 |
| 4,404,716 | 9/1983 | Foust | 27/12 |

*Primary Examiner*—Alexander Grosz
*Assistant Examiner*—Michael F. Trettel
*Attorney, Agent, or Firm*—Woodard, Weikart, Emhardt & Naughton

[57] ABSTRACT

A coffin bed adjusting apparatus for providing both elevation and tilt adjustments to a coffin bed in a burial casket. The bed frame is connected to a bed support member which is pivotally mounted to an elevating support member. The elevating support member is threadedly mounted on a threaded shaft, the rotation of which adjusts the vertical height of the bed. A rack is slidably mounted on a threaded shaft, the rotation of which adjusts the vertical height of the bed. A rack is slidably mounted to the elevating support member, and is engaged to a pinion which is also mounted to the elevating support member. The rotation of the pinion drives the rack, which translates the rotating movement into a pivoting of the bed support member thereby causing a desired tilt of the casket bed frame. This pivoting is achieved by the interaction of a slot in the bed support member and an arm on the rack. The pinion which moves the rack is rotated by a second shaft. The second shaft engages the pinion only to rotate it but the pinion freely slides vertically on the second shaft.

23 Claims, 26 Drawing Figures

COFFIN BED ADJUSTING APPARATUS

REFERENCE TO RELATED APPLICATION

This patent application is a continuation-in-part patent application of my prior co-pending patent application Ser. No. 405,993 filed on Aug. 6, 1982, now U.S. Pat. No. 4,404,716.

BACKGROUND OF THE INVENTION

This invention relates in general to an apparatus for adjusting coffin beds, and more particularly, to an apparatus for adjusting both the vertical height and the tilt of a bed in a burial casket.

It is desirable to be able to adjust the vertical height and the tilt of a coffin bed within a casket. These adjustments are utilized so that the deceased may be appropriately viewed during memorial services. In the past, devices for so adjusting the height and tilt of coffin beds generally have not been of simple construction and have either been cumbersome to use or of complicated and expensive construction. It is also desirable that the devices be made from uniform parts and be readily used with various sizes of coffins.

The following is a list of U.S. Patents which disclose various adjustable coffin beds. These patents disclose a wide variety of coffin bed adjusting mechanisms.

| U.S. Pat. No. | Patentee |
|---|---|
| 289,643 | Goff |
| 1,800,793 | Harms |
| 1,934,425 | Harms |
| 2,051,163 | Corrigan |
| 2,159,144 | Fletcher |
| 2,729,875 | White |
| 2,848,781 | Slaughter et al. |
| 2,888,732 | Nelson |
| 3,065,516 | Dower |
| 3,192,596 | Gruber |
| 3,300,828 | Hegman et al. |
| 3,300,829 | Hegman et al. |
| 3,539,142 | Morand |
| 3,568,275 | Carson |
| 3,653,104 | Nelson |
| 2,670,517 | Hillenbrand et al. |
| 2,839,814 | Harter |
| 3,692,267 | Kronas |
| 4,070,737 | Peterson |

U.S. Pat. No. 289,643 to Goff discloses a device using notch standards to raise and lower the bed. The use of notches as in Goff and in other patents tends to make manipulation and adjustment of the bed cumbersome since the entire bed is moved by hand and not by the use of a mechanism. U.S. Pat. No. 1,800,793 to Harms discloses a device which uses a complicated hinged levering mechanism centrally located beneath the bed, and requires a number of complicated parts and materials. U.S. Pat. No. 1,934,425 to Harms discloses another notch and lever tilting device which requires several parts and a curved notched member. U.S. Pat. No. 2,051,163 to Corrigan discloses yet another complicated notch and bar elevating mechanism. U.S. Pat. No. 2,159,144 to Fletcher discloses a large mechanism which tilts an entire casket. U.S. Pat. No. 2,729,875 to White discloses a device which uses a horizontal rod and a column of apertures, and is similar in use to the notch devices. Slaughter et al. discloses a device which requires the actual tilting of the bed itself upon a pivoting point after a nut and screw which maintains the tilt is loosened. This device must be tilted by hand and requires reaching into the coffin to get at the screw to loosen it. U.S. Pat. No. 2,888,732 to Nelson discloses a complex mechanical device using several lever arms with pivoting points. U.S. Pat. Nos. 3,192,596 to Gruber, 3,300,828 to Hegman et al., and 3,568,275 to Carson also disclose the use of notched members to adjust the height of the bed.

U.S. Pat. No. 3,065,516 to Dower discloses a tilting apparatus using springs and a number of complicated tilting mechanisms. Various angles are achieved by rotating a number of threaded shafts through a number of elevation members which have bed support members pivotally mounted to them. The apparatus disclosed requires a complicated device and a number of mechanisms to achieve tilting and height adjustment. The disclosed device shows the use of five separate mechanisms to adjust the tilt and elevation of the bed.

U.S. Pat. No. 3,539,142 to Morand discloses a device which adjusts the vertical position of the coffin bed and maintains the height adjustment with a spring release mechanism. The mechanism does not provide for tilting the coffin bed on an axis that runs the length of the coffin.

U.S. Pat. No. 3,653,104 to Nelson discloses a device which uses a housing and a bed support member which is pivotally mounted to the housing. The bed support member is tilted by a connection to a first shaft travels vertically up to pivot a bed support member. U.S. Pat. No. 2,670,517 to Hillenbrand et al. discloses a device which has a pair of plates pivotally mounted to each other. One plate is connected to the coffin bed and has a curved gear at one end. A worm gear drives the curved gear so that the coffin bed plate pivots on the other plate. U.S. Pat. No. 2,839,814 to Harter discloses the basic twin plate idea of Hillenbrand et al. U.S. Pat. No. 2,670,517 but obtains the pivoting of the bed supporting plate by the use of a push rod rather than a worm gear and a curved plate gear. The user has to reach to tighten a nut to keep the bed tilted.

U.S. Pat. No. 3,692,267 to Kronas is directed to the relative positioning of the vertical threaded shaft of a coffin bed height adjustment mechanism. The device is simply a disc with an aperture that has a diameter that is greater than the minimum diameter of the threaded shaft and less than the maximum diameter of that shaft. The disc can thus be "wobbled" into position to fix the relative height of the shaft. U.S. Pat. No. 4,070,737 to Peterson discloses a coffin bed adjusting mechanism which employs a collar and locking screw combination to select the relative height of the threaded shaft.

SUMMARY OF THE INVENTION

The present invention relates to a new and unique apparatus for elevating and tilting a bed in a burial casket. In one embodiment, a support member is attachable to a bed, the support member includes an internally threaded channel. A vertical threaded rod threadedly engages with the internally threaded channel of the support member, the rotation of the rod vertically adjusts the position of the support member along the threaded rod. The threaded rod further has a keyway along the lower portion of the rod. There are mounting means for vertically mounting the threaded rod to the casket in free rotation. The mounting means includes a first mounting member attachable to the casket at the base of the casket, the first mounting member defines an aperture through which the lower portion of the threaded rod is insertable. A first stop member having a threaded aperture is threadedly received on the rod above the first mounting member. A second stop member defining a key aperture is received on the rod above the first mounting member. The second stop member engages the keyway to be slidable along the rod and to be immobile in a rotational direction about the rod. There are stop member locking means for locking the first stop member to the second stop member to form a stop assembly which engages with the first mounting member to maintain a fixed length of the rod inserted into the aperture.

DESCRIPTION OF THE PREFERRED EMBODIMENT

Figure 1:
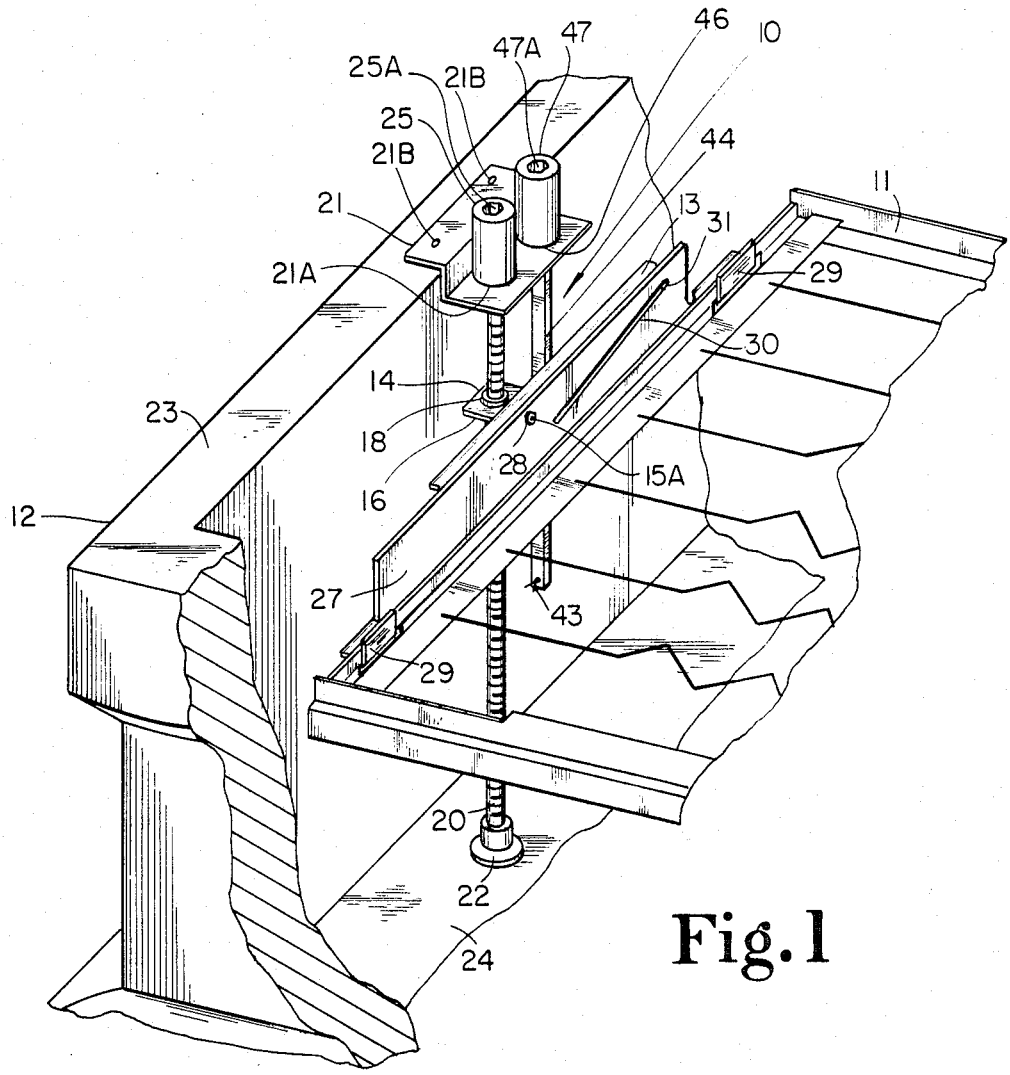
FIG. 1 is a perspective, fragmentary view of a preferred embodiment of the coffin bed adjusting apparatus mounted to a burial casket for tilting the bed mounted in the casket.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is shown an elevating and tilting apparatus 10 for altering the vertical height and the side to side tilt of a bed frame 11 which is contained in a burial casket 12. This elevating and tilting apparatus allows the user to adjust the vertical height and the side to side tilt of the bed frame to facilitate the viewing of the deceased during the funeral ceremony.

Figure 2:
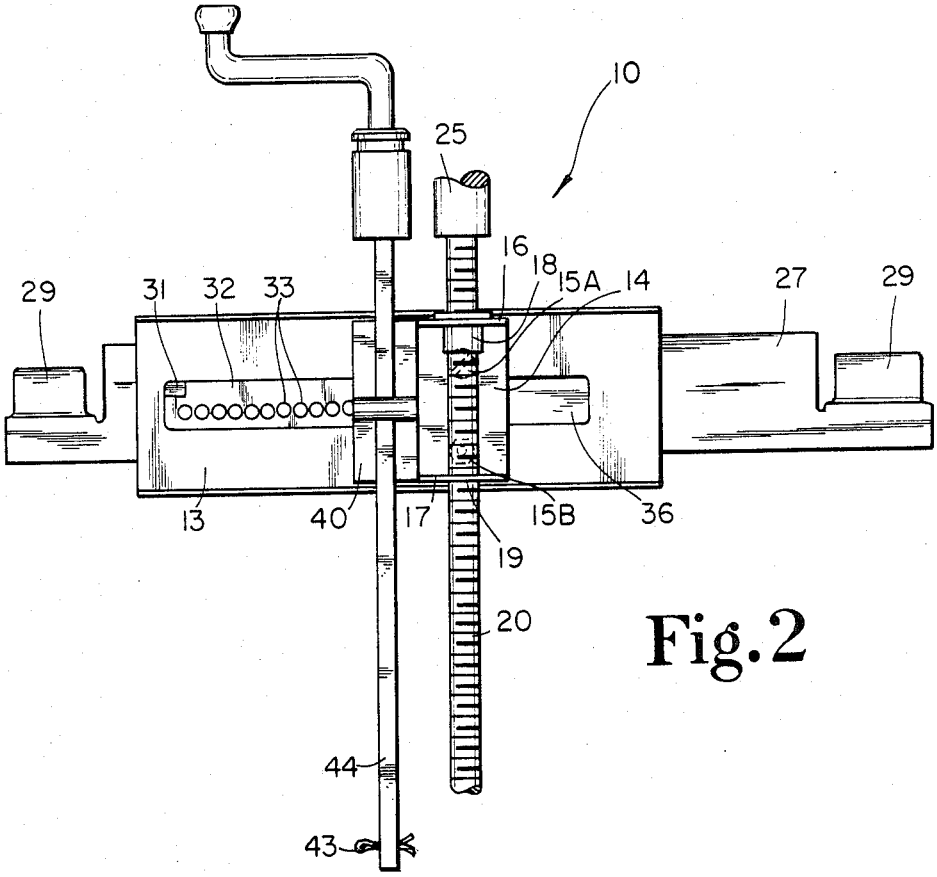
FIG. 2 is a front elevational view of a coffin bed adjusting apparatus.

Referring to FIG. 2, elevating support member 13 is connected to U-shaped bracket 14 by bolts 15A and 15B which pass through respective holes 15C and 15D in elevating support member 13 and through holes 15E and 15F of U-shaped bracket 14. Bracket 14 has a top bracket flange 16 and a bottom bracket flange 17. Top bracket flange 16 defines an internally threaded channel 18. Bottom bracket flange 17 defines threaded bracket channel 19 which is coaxial with threaded bracket channel 18.

Figure 15:
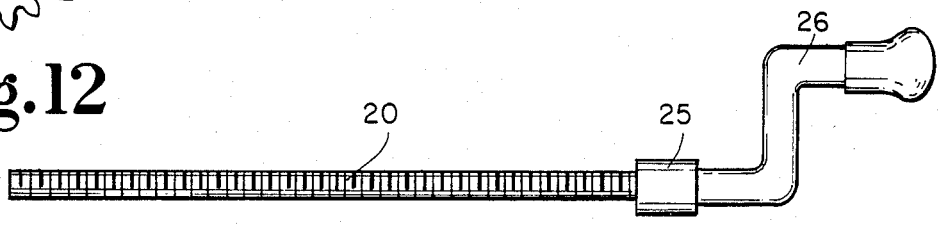
FIG. 15 is a front elevational view of the elevation means screw shaft and hand crank.

Vertical rod 20 is threadably received by bracket channels 18 and 19 as is shown in FIG. 2. Vertical rod 20 is freely rotationally mounted within bracket 21 and receiving member 22 as is shown in FIG. 1, so that the rod will freely rotate within a channel 21A in bracket 21 and within receiving member 22. Bracket 21 is mounted to the top side of burial casket 23 by suitable means such as screws 21B. Receiving member 22 is mounted to the bottom of burial casket 24. As is shown in FIG. 1, the top of vertical rod 20 has a hand crank receiving member 25. In the preferred embodiment, receiving member 25 has a polygonally-shaped depression 25A to receive hand crank 26 (shown in FIG. 15). The rotation of vertical rod 20 causes bracket 14 to be displaced either upward or downward, depending upon the direction of the rotation of rod 20, because of the action of the threads of rod 20 with the internal threads of bracket channels 18 and 19.

Bed support member 27 is pivotally mounted to elevating support member 13 by bolt 15A through hole 28 in bed support member 27 and hole 15C in elevating support member 13 and hole 15E in bracket 14. Bed frame 11 rests in bed frame arms 29 of bed support member 27. Consequently, when the vertical height of bed support member 27 is adjusted, bed frame 11 is also altered in vertical height. In this fashion, the entire elevating support member and the rest of the apparatus can be altered in vertical height by the turning of a hand crank 26 thus resulting in the altering of vertical height of the bed frame and the bed within the casket as is shown in FIG. 1.

Figure 4:
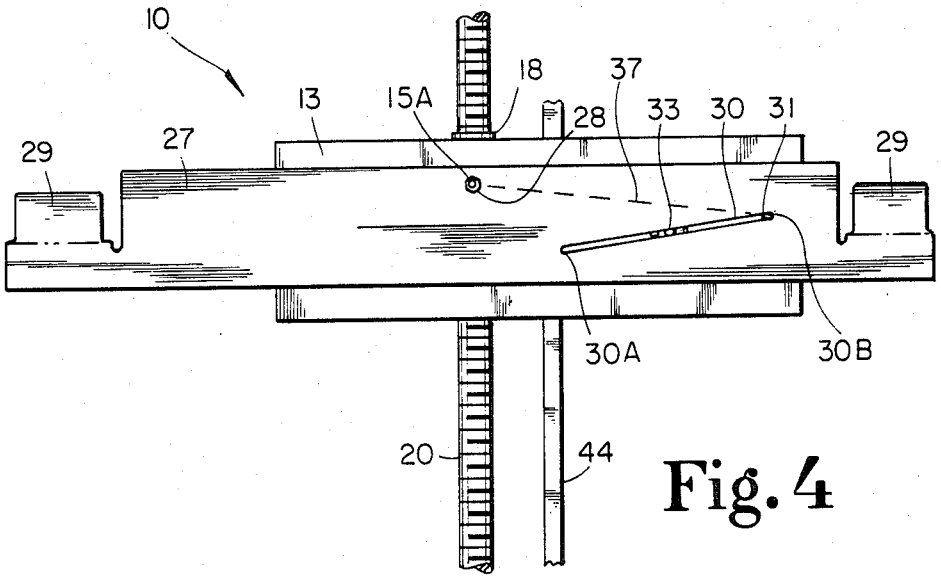
FIG. 4 is a back elevational view of a coffin bed adjusting apparatus showing the bed support member in a horizontal position.
Figure 5:
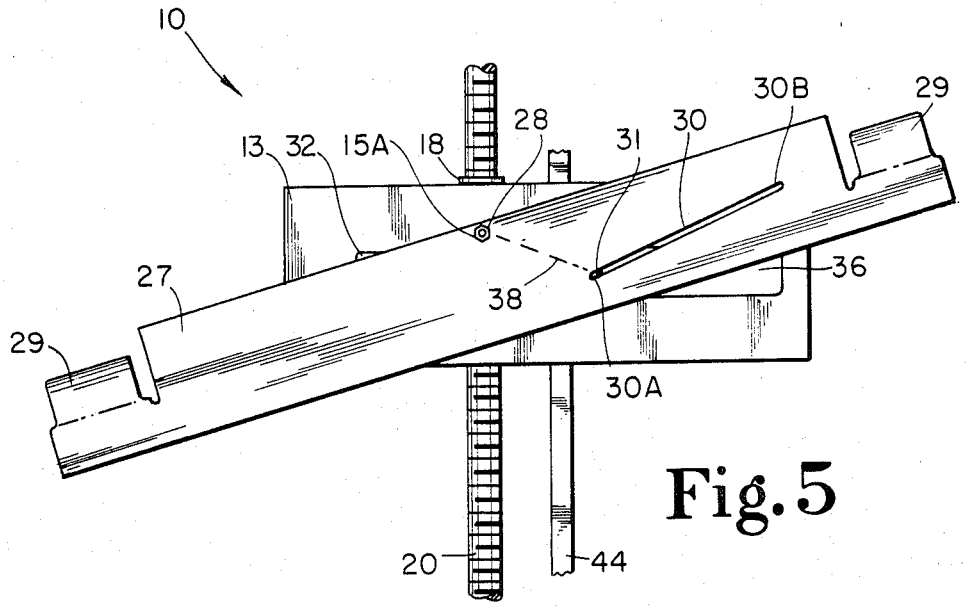
FIG. 5 is a back elevational view of a coffin bed adjusting apparatus showing the bed support member in a tilted position.
Figure 6:
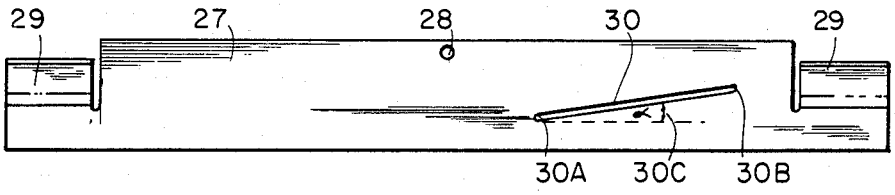
FIG. 6 is a front elevational view of the bed support member of the preferred embodiment.
Figure 6A:
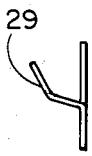
FIG. 6A is a side elevational view of the bed support member of FIG. 6.

Bed support member 27 is pivotally mounted to elevating support member 13 at point 28. Thus, bed support member 27 can be tilted to cause side-to-side tilting of bed frame 11. This side-to-side tilt of bed support member 27 is caused by a motion translation means, the preferred embodiment for which will now be described. Slot 30 in bed support member 27 has a first slot end 30A and an opposite slot end 30B as is shown in FIG. 6. Slot 30 has an angle from the horizontal from end 30A to end 30B of alpha which is shown as 30C. Arm 31 is received within slot 30, and the shifting of arm 31 along slot 30 causes bed support member 27 to pivot about point 28. Arm 31 is as shown from FIGS. 10 and 11 on a rack member 32. Rack 32 having pinion holes 33. Rack 32 is maintained in a fixed vertical position and its horizontal position is altered, causing arm 31 to slide within slot 30 from slot end 30A toward slot end 30B causing bed support member 27 to pivot about pivot point 28, as is shown in FIGS. 4 and 5. In FIG. 4, arm 31 is at slot end 30B and bed support member 27 is in a horizontal position. In FIG. 5, arm 31 is at slot end 30A and bed support member 27 is fully tilted.

Figure 7:
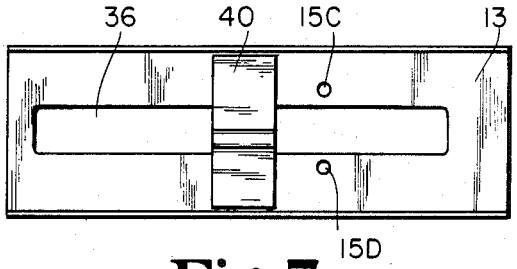
FIG. 7 is a front elevational view of the elevating support member of the preferred embodiment.
Figure 10:
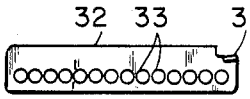
FIG. 10 is a side elevational view of the rack of the preferred embodiment.
Figure 11:
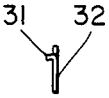
FIG. 11 is a side elevational view of the rack of FIG. 10.
Figure 13:
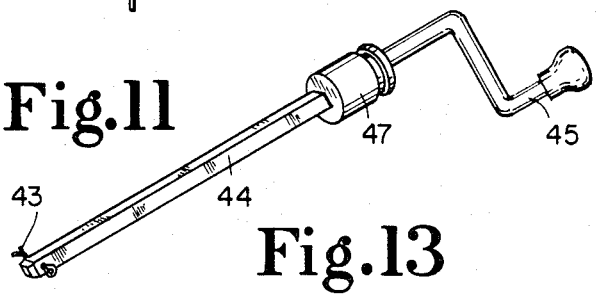
FIG. 13 is a perspective view of the pinion driving rod and hand crank of the preferred embodiment.

As is shown in FIG. 10, arm 31 is connected to rack 32 which slidably fits within rack slot 36 (FIG. 7) in elevating support member 13. Slot 36 is long enough so that the rack can slide from one end of slot 36 to the other end of slot 36 so that arm 31 of the rack will appropriately slide from one end of slot 30A to the other end 30B of slot 30. It is the action of arm 31 upon slot 30 which causes bed support member 13 to pivot. It should be noted that the length of leverage distance 37 from pivot point 28 to the engagement of arm 31 with slot 30 provides substantial mechanical advantage, thereby facilitating the tilting of bed frame 11 while it is laiden with a corpse. This leverage decreases as the angle of tilt increases, (see leverage distance 38 in FIG. 5) and as the useful benefit of the advantage also diminishes. By suitably selecting angle alpha 30C from the horizontal, particular desired mechanical advantage over a range of tilt may be determined for any specific apparatus.

Figure 3:
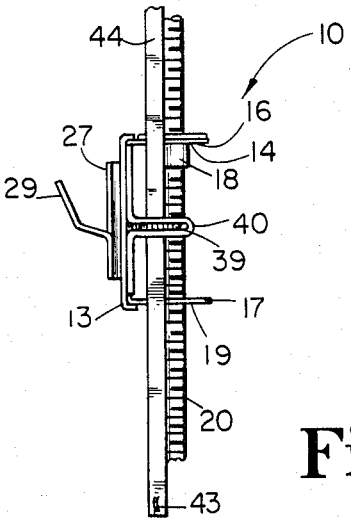
FIG. 3 is a side elevational view of a coffin bed adjusting apparatus.
Figure 8:
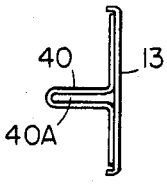
FIG. 8 is a side elevational view of the elevating support member of FIG. 7.
Figure 9:
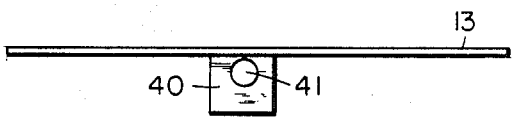
FIG. 9 is a top elevational view of the elevating support member of FIG. 7.
Figure 14:
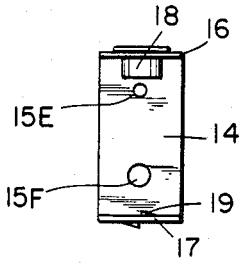
FIG. 14 is a front elevational view of the elevation means bracket.
Figure 12:
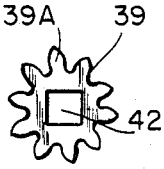
FIG. 12 is a top elevational view of the pinion used of the preferred embodiment.

As pointed out, rack 32 slides within rack slot 36. This sliding is caused by the action of pinion 39 which is shown in FIG. 12 and which has gear teeth 39A that mesh with rack holes 33. Pinion 39 is disposed in a horizontal plane as shown in FIG. 3 so that when it rotates it engages rack 32 and slides rack 32 back and forth, depending upon the direction of rotation, within slot 36. This configuration enhances stability at any particular tilt position. As can be seen in FIG. 3, pinion 39 is located within pinion housing 40 which is connected to elevating support member 13. As is shown in FIGS. 3 and 8, pinion housing 40 receives pinion 39 within pinion gap 40A. Pinion housing 40 has a channel 41 which is coaxial with pinion channel 42. As can be seen from FIGS. 2 and 3, when rack 32 is in rack slot 36 it cannot move in the vertical direction because of elevating support member 13 and does not come out of rack slot 36 even though elevating support member 13 is a thin piece of metal because it is held there on one side by the action of bed support member 27 and on the other side by pinion 39 and pinion housing member 40.

Pinion 37 is rotated by rotating pinion rod 44, which has a square cross-section and fits through pinion channel 42. The engagement of pinion rod 44 and pinion 39 is such that when the pinion's vertical height is altered because elevating support member's (13) vertical height is altered, pinion 39 slides vertically on rod 44 and pin 43 keeps rod 44 from being pulled out. But when rod 44 is turned by hand crank 45, pinion 37 is caused to rotate, thus moving rack 32 within slot 36. The sliding action of rack 32 causes arm 31 to move within slot 30 which in turn causes the pivoting of bed support member 27 about its pivot point 28, resulting in the tilting of bed frame 11. Finally, pinion rod 44 goes through pinion rod channel 46 in bracket 21 which is mounted to casket 12 as is shown in FIG. 1. Pinion rod 44 also includes hand crank receiving member 47 which has a polygonal depression 47A to receive hand crank 45.

Figure 16:
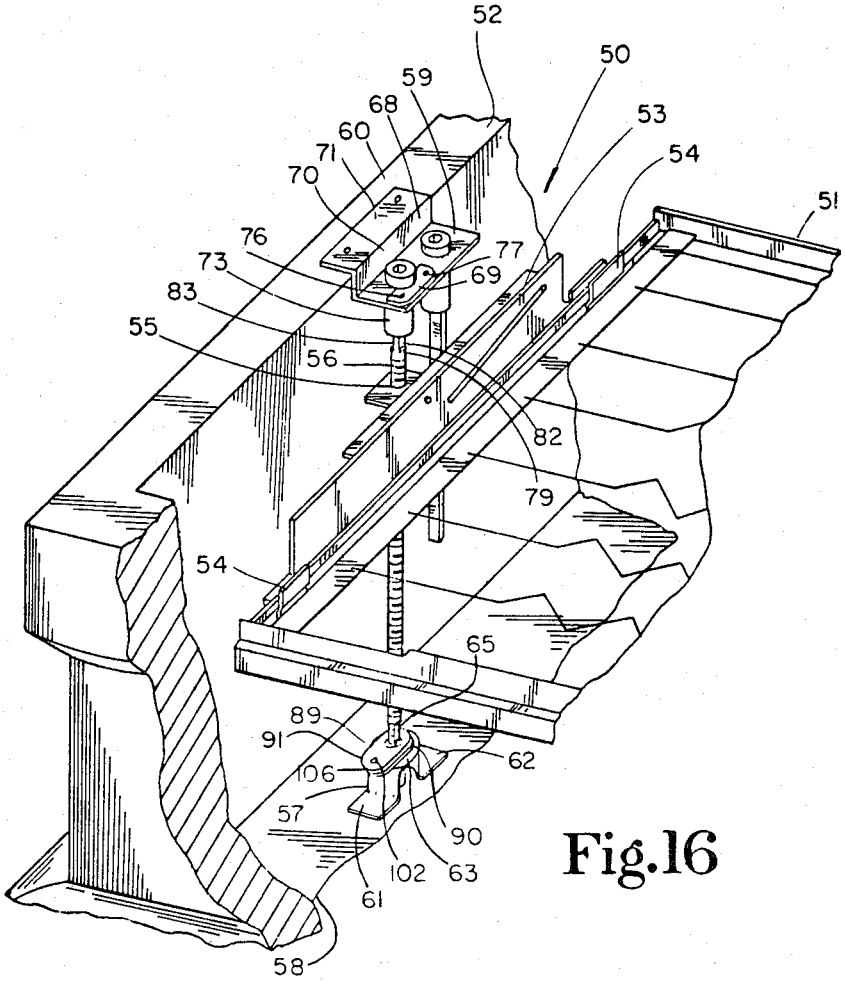
FIG. 16 is a perspective, fragmentary view of a preferred embodiment of the coffin bed adjusting apparatus mounted to a burial casket for tilting the bed mounted in the casket and showing an apparatus for fixing the effective length of the elevation adjusting rod.

Referring to FIG. 16, there is shown an elevating and tilting apparatus 50 for altering the vertical height and the side to side tilt of bed frame 51 which is contained in burial casket 52. This elevating and tilting apparatus allows the user to adjust the vertical height and the side to side tilt of the bed frame to facilitate the viewing of the deceased during the funeral ceremony. The apparatus has a support member 53 to which bed frame 51 is attached by it resting in bed frame arms 54 of support member 53. Support member 53 also includes internally threaded channel 55 through which vertical threaded rod 56 is threadedly received. Rod 56 is mounted to the casket by mounting means so that it is vertical and in free rotation. The rotation of rod 56 causes the vertical adjustment of the position of support member 53 along threaded rod 56.

Figure 18:
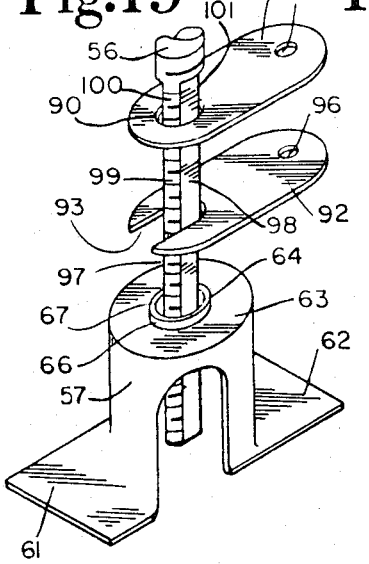
FIG. 18 is a perspective view of a preferred embodiment of the stop members on the lower portion of the threaded rod.

The mounting means for attaching rod 56 to casket 52 have first and second mounting members. First mounting member 57 for mounting rod 56 is attached to base 58 of the casket. Second mounting member 59 is attached to top 60 of casket 52 directly above first mounting member 57. Mounting member 57 is generally U-shaped having a pair of base flanges 61 and 62 which are attached to casket base 58. As shown in FIG. 18, top plate 63 of the U-shaped member 57 has an aperture 64 disposed in it. Lower portion 65 of rod 56 is inserted through aperture 64. Cylindrical plastic sleeve 66 having central bore 67 is disposed in aperture 64 so that threads 68 of rod 56 do not catch on the metal of top plate 63 so that rod 56 will easily slide through aperture 64 and be received in free rotation within the sleeve's central bore 67.

Figure 24:
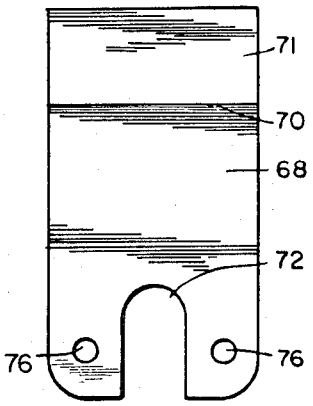
FIG. 24 is a top plan view of a preferred embodiment of the second mounting member of the present invention.
Figure 26:
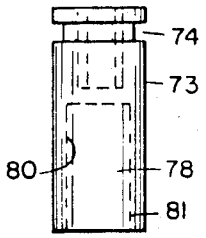
FIG. 26 is a side elevational view in cross section of the rod mounting cylinder of the preferred embodiment.
Figure 25:
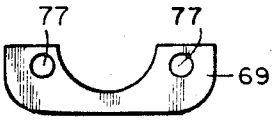
FIG. 25 is a top plan view of a rod mounting cylinder retention member to be assembled with the second mounting member of the preferred embodiment.

Second mounting member 59 has first plate 68 and second plate 69 as shown in FIGS. 24 and 25 respectively. First plate 68 has angled portion 70 and flange 71 which is attached to the top of casket 60. The opposite end of first plate has slot 72. Slot 72 receives cylindrical member 73. Cylindrical member 73 as shown in FIG. 26 has groove 74 about its periphery adjacent its upper end. The diameter of the groove is slightly smaller than the width of slot 72. Slot 72 receives groove 74 and second plate 69 is secured to first plate 68 so that slot 75 of second plate 69 and slot 72 of the first plate 68 enclose groove 74 of cylindrical member 73. The securing of first plate 68 to second plate 69 is achieved by passing rivets or other suitable fasteners through holes 76 and 77 of the respective plates. Thereby cylindrical member 73 is vertically supported by plates 68 and 69 and yet is free to rotate.

The combination of the plates and cylindrical member 73 provides second mounting member for rod 56 and a rod turning means. This rod turning means is for transferring rotation to rod 56. Cylindrical member 73, as shown in FIG. 26, has a rod receiving opening which is partial bore 78. Upper portion 79 of rod 56 is inserted into bore 78. Bore 78, in the preferred embodiment, has two flat surfaces 80 and 81. Upper portion 79 of rod 56 also has two flat portions 82 and 83 along a portion of its length. Thus when the rod is inserted into bore 78 the corresponding flat sides 80, 81, 82 and 83 would cause the rotation of cylindrical member 73 to be transferred to rod 56. Further, the insertion of the rod in bore 78 maintains the rod in a vertical orientation.

Figure 19:
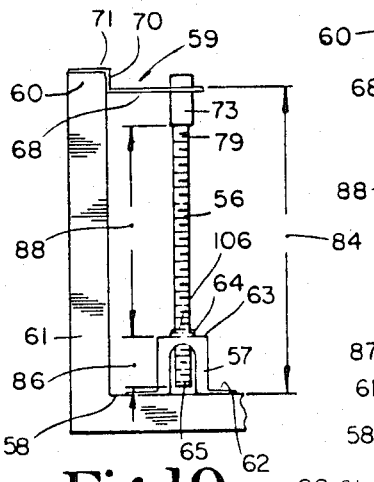
FIG. 19 is a side elevational view of a threaded rod having a first effective length determined by the preferred embodiment of an apparatus for fixing the effective length of the elevation adjusting rod.
Figure 20:
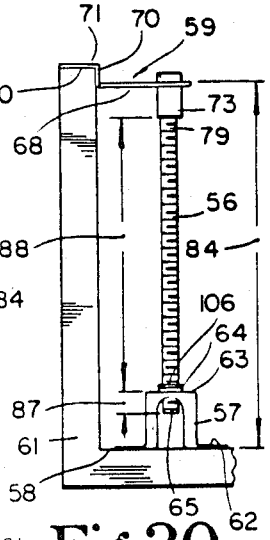
FIG. 20 is a side elevational view of a threaded rod having a second effective length determined by the preferred embodiment of an apparatus for fixing the effective length of the elevation adjusting rod.

Because people come in all different sizes and shapes, caskets tend to be of different sizes and shapes. Particularly, vertical heighth 84 of a casket often varies. While this variation in casket heighth is unavoidable, the present invention's structure provides for the standardization of the elevation and tilting apparatus. This is accomplished by a mounting system which is adapted to mount a rod of standard length to achieve various effective lengths. Thereby, the same type and length of rod is used with a wide variety of casket sizes. In the preferred embodiment, as rod 56 enters aperture 64, the rod's lower portion 65 may extend below top plate 63 to various lengths before it encounters the base of casket 58. Examples of this variable length of extension are the rod lower portion being extended a distance 86 in FIG. 19 and a lesser distance 87 in FIG. 20. Because of this variable extension the effective length 88 of the rod 56 can also be varied. The effective length 88 as defined herein means the height of rod 56 to which the rod can be used in a coffin to raise and lower support member 53. As can be discerned from FIGS. 19 and 20 the ability to variate the effective length allows the use of the same rod in caskets of different heights 84. Stop members are provided to fix the rod at a chosen effective length 88.

Figure 21:
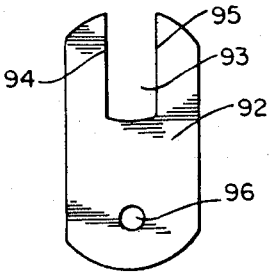
FIG. 21 is a top plan view of a preferred embodiment of the second stop member of the present invention.
Figure 22:
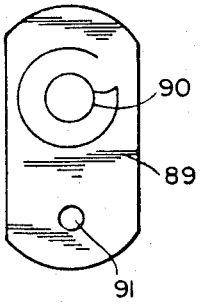
FIG. 22 is a top plan view of a preferred embodiment of the first stop member of the present invention.
Figure 23:
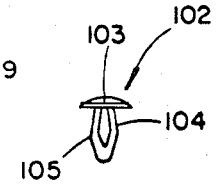
FIG. 23 is a side elevational view of the pin insert member of the preferred embodiment.

First stop member 89 is a flat plate as shown in FIG. 22. Plate 89 has threaded aperture 90 and is threadedly received on rod 56 at a point above first mounting member 57. Plate 89 has locking aperture 91 spaced from aperture 90. Second stop member 92 is a flat plate. Plate 92 has a key aperture in the form of slot 93 as shown in FIG. 21. Key aperture 93 has a preferred shape which has two opposite flat sides 94 and 95. Second stop member 92 also has locking aperture 96 spaced from key aperture 93.

In the preferred embodiment, as shown in FIG. 18, lower portion 65 of rod 56 has a keyway along its length. This keyway may be of various shapes. The preferred embodiment has keyway 97 which has opposite continuous flat surfaces 98 and 99 machined on the length of lower portion 65 of rod 56. Rod 56 along lower portion 65 has its threads 68 machined into a flat surface along two opposite parallel faces 98 and 99. The perpendicular faces 100 and 101 along this length of rod 56 retain their threads. In this manner a keyway is formed whereby members having specific shapes will slide along lower portion 65 of rod 56 while threaded members will continue to be threadedly engaged with threaded faces 100 and 101.

Key aperture 93 is thus shaped to be received along lower portion 65 along keyway 97 so that as shown in FIG. 18, second stop member 92 slides along the rod in a vertical direction but is unable to rotate about the rod. On the other hand, first stop member 89 continues to be threadedly received along the entire keyway 97 and does not slide vertically on rod 56. Stop member locking means are provided when stop members 89 and 92 are adjacent to each other on the rod and they are locked together by passing locking insert 102 through their respective locking apertures 91 and 96. Locking insert 102 in the preferred embodiment is a plastic canoe pin 102. Insert 102 has top flange 103 and main body 104. The main body has a deformable locking ridge 105. Deformable locking ridge 105 and top flange 103 are both larger than locking apertures 91 and 96. Thus once insert 102 is inserted into the apertures, ridge 105 deforms during insertion and undeforms once through the apertures to maintain insert 102 in place.

Figure 17:
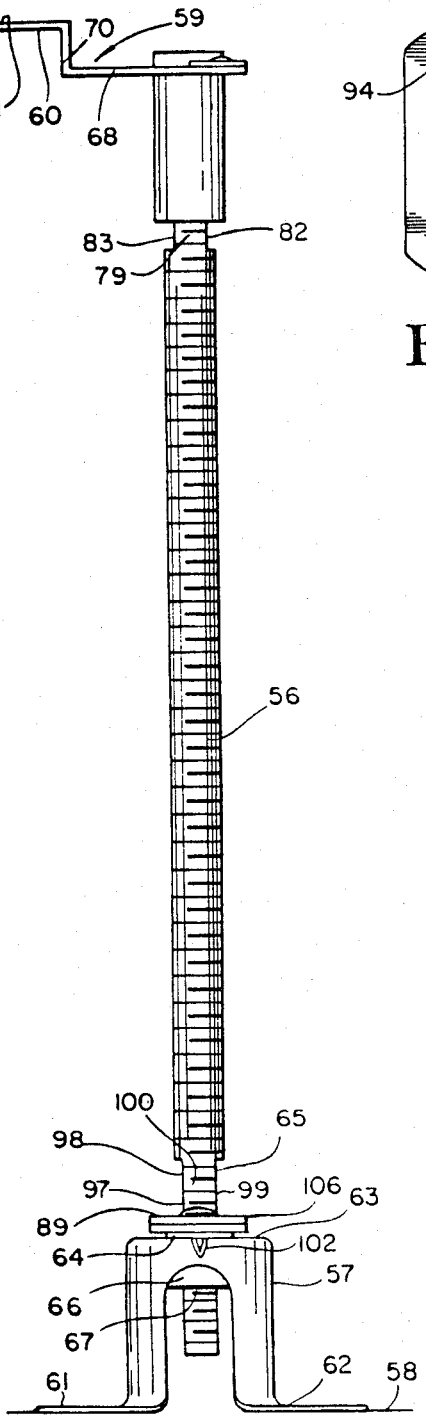
FIG. 17 is a side elevational view of a coffin bed adjusting apparatus showing an apparatus for fixing the effective length of the elevation adjusting rod.

The locking of first stop member 89 to second stop member 92 forms lock assembly 106 as shown in FIG. 17. Assembly 106 can be located at any point along lower portion 65 of the rod 56. This is done by rotating first stop member 89 into the desired position and then sliding second stop member 92 against first stop member 89 on the rod. Once insert 102 is in place it locks the two stop members together and they are no longer mobile along the rod. The threads of the first stop member prevent sliding and the flat surfaces of keyway 97 and keyway aperture 93 prevent rotation. Stop assembly 106 thus comes to rest atop top plate 63 as shown in FIG. 17 and the further insertion of rod 56 into aperture 64 is prevented. The stop assembly maintains a fixed length of rod 56 inserted into aperture 64 and the effective length of the rod is fixed. Of course various effective lengths are accomplished depending upon what point stop assembly 106 is placed along lower portion 65 of rod 56.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. An apparatus for elevating a bed in a burial casket, said apparatus comprising:

an elevating support member;

a bed support member pivotally mounted to said elevating support member, said bed support member including an elongated slot which has a first slot end and a second opposite slot end, said first slot end being closer to said pivoting point than said second opposite slot end;

tilting means mounted to said elevating support member, said tilting means including an arm which is slidably received in said elongated slot so that the sliding of the arm causes contact with the walls of the slot resulting in pivoting of the bed support member about its pivoting point;

a bracket in fixed relation with said elevating support member, said bracket including an internally threaded channel;

a vertical threaded rod threadedly engaged with said internally threaded channel of said bracket, the rotation of said rod vertically adjusting the position of said bracket along said threaded rod, said threaded rod further having a keyway along the lower portion of said rod;

mounting means for vertically mounting said threaded rod to said casket in free rotation, said mounting means including a first mounting member attachable to the casket at the base of the casket, said first mounting member defining an aperture through which said lower end of said threaded rod is insertable;

a first stop member having a threaded aperture threadedly received on said rod above said first mounting member;

a second stop member defining a key aperture received on said rod above said first mounting member, said second stop member engaging said keyway to be slidable along said rod and to be immobile in a rotational direction about said rod;

stop member locking means for locking said first stop member to said second stop member to form a stop assembly which engages with said first mounting member to maintain a fixed length of said rod inserted into said aperture.

2. The apparatus of claim 1 wherein said mounting means includes a second mounting member attachable to the casket at the top of the casket above said first mounting member, and rod turning means rotatably mounted to said second mounting member, said rod turning means being for transferring rotation to said rod, said rod turning means includes a cylindrical member which is vertically mounted in free rotation to said second support member, said cylindrical member defining a rod receiving opening in which the top end of said threaded rod is insertable to transfer rotation of the cylinder to the threaded rod.

3. The apparatus of claim 2 wherein said first stop member has a first locking aperture spaced apart from said threaded aperture;

said second stop member having a second locking aperture spaced apart from said key aperture; and said stop member locking means includes a locking insert member adapted to pass through said first and second locking apertures to lock said first and second stop members together.

4. The apparatus of claim 3 wherein said keyway has two continuous parallel flat surfaces along the lower portion of said rod and said second stop member defines a key aperture having two parallel flat surfaces corresponding to said keyway flat surfaces.

5. The apparatus of claim 4 wherein said locking insert has a top flange and an opposite deformable locking ridge, said deformable locking ridge and said top flange both being larger than said first and second locking apertures to maintain the locking insert within said apertures.

6. An apparatus for elevating a bed in a burial casket, said apparatus comprising:

a support member attachable to a bed, said support member including an internally threaded channel;

a vertical threaded rod threadedly engaged with said internally threaded channel of said support member, the rotation of said rod vertically adjusting the position of said support member along said threaded rod, said threaded rod further having a keyway along the lower portion of said rod;

mounting means for vertically mounting said threaded rod to said casket in free rotation, said mounting means including a first mounting member attachable to the casket at the base of the casket, said first mounting member defining an aperture through which said lower portion of said threaded rod is insertable;

a first stop member having a threaded aperture threadedly received on said rod above said first mounting member;

a second stop member defining a key aperture received on said rod above said first mounting member, said second stop member engaging said keyway to be slidable along said rod and to be immobile in a rotational direction about said rod; and stop member locking means for locking said first stop member to said second stop member to form a stop assembly which engages with said first mounting member to maintain a fixed length of said rod inserted into said aperture.

7. The apparatus of claim 6 wherein said keyway has two parallel flat surfaces and said second stop member defines a key aperture having two parallel flat surfaces corresponding to said keyway flat surfaces.

8. The apparatus of claim 7 wherein said two keyway parallel flat surfaces are continuous along a portion of said threaded rod adjacent said lower end of said rod.

9. The apparatus of claim 6 wherein said mounting means includes a second mounting member adapted to be attached adjacent the top of said casket above said first mounting member, and rod turning means rotatably mounted to said second mounting member, said rod turning means being for transferring rotation to said rod.

10. The apparatus of claim 9 wherein said rod turning means includes a cylindrical member which is vertically mounted in free rotation to said second support member, said cylindrical member defining a rod receiving opening in which the top end of said threaded rod is insertable to transfer rotation of the cylinder to the threaded rod.

11. The apparatus of claim 6 wherein said first stop member has a first locking aperture spaced apart from said threaded aperture;

said second stop member having a second locking aperture spaced apart from said key aperture; and said stop member locking means includes a locking insert member adapted to pass through said first and second locking apertures to lock said first and second stop members together.

12. The apparatus of claim 11 wherein said locking insert has a top flange and an opposite deformable locking ridge, said deformable locking ridge and said top flange both being larger than said first and second locking apertures to maintain the locking insert within said apertures.

13. A support system for a burial casket elevation adjustment apparatus, the elevation adjustment apparatus including a support member having an internally threaded channel, said system comprising:

a vertical threaded rod threadedly engaged with said internally threaded channel of said support member, the rotation of said rod vertically adjusting the position of said support member along said threaded rod, said threaded rod further having a keyway along the lower portion of said rod;

a first mounting member attachable to the casket at the base of the casket, said first mounting member defining an aperture through which said lower portion of said threaded rod is insertable;

a second mounting member attachable to the casket at the top of the casket above said first mounting member;

rod turning means rotatably mounted to said second mounting member, said rod turning means being for transferring rotation to said rod;

a first stop member having a threaded aperture threadedly received on said rod above said first mounting member;

a second stop member defining a key aperture received on said rod above said first mounting member, said second stop member engaging said keyway to be slidable along said rod and to be immobile in a rotational direction about said rod; and stop member locking means for locking said first stop member to said second stop member to form a stop assembly which engages with said first mounting member to maintain a fixed length of said rod inserted into said aperture.

14. The apparatus of claim 13 wherein said keyway has two continuous parallel flat surfaces along the lower portion of said rod and said second stop member defines a key aperture having two parallel flat surfaces corresponding to said keyway flat surfaces.

15. The apparatus of claim 13 wherein said rod turning means includes a cylindrical member which is vertically mounted in free rotation to said second support member, said cylindrical member defining a rod receiving opening in which the top end of said threaded rod is insertable to transfer rotation of the cylinder to the threaded rod.

16. The apparatus of claim 13 wherein said first stop member has a first locking aperture spaced apart from said threaded aperture;

said second stop member having a second locking aperture spaced apart from said key aperture; and said stop member locking means includes a locking insert member adapted to pass through said first and second locking apertures to lock said first and second stop members together.

17. The apparatus of claim 16 wherein said locking insert has a top flange and an opposite deformable locking ridge, said deformable locking ridge and said top flange both being larger than said first and second locking apertures to maintain the locking insert within said apertures.

18. An apparatus for fixing the effective length of the elevation adjusting rod in a casket bed elevation adjustment system, said apparatus comprising:

a vertical threaded elevation adjusting rod having a keyway along the lower portion of said rod;

a first mounting member attachable to the casket at the base of the casket, said first mounting member defining an aperture through which said lower portion of said threaded rod is insertable;

a first stop member having a threaded aperture threadedly received on said rod;

a second stop member defining a key aperture received on said rod, said second stop member cooperatively engaging said keyway to be slidable along said rod on said keyway and to be immobile in a rotational direction about said rod; and stop member locking means for locking said first stop member to said second stop member to form a stop assembly which engages with said first mounting member to maintain a fixed length of said rod inserted into said passageway.

19. The apparatus of claim 18 further comprising a second mounting member adapted attachable to the casket at the top of the casket above said first mounting member, and rod turning means rotatably mounted to said second mounting member, said rod turning support means being for transferring rotation to said rod, said rod turning means includes a cylindrical member which is vertically mounted in free rotation to said second support member, said cylindrical member defining a rod receiving opening in which the top end of said threaded rod is insertable to transfer rotation of the cylinder to the threaded rod.

20. The apparatus of claim 19 wherein said keyway has two continuous parallel flat surfaces along the lower portion of said rod and said second stop member defines a key aperture having two parallel flat surfaces corresponding to said keyway flat surfaces.

21. The apparatus of claim 20 wherein said first mounting member is generally U-shaped having a pair of base flanges mountable to the base of the casket at the open end of the U-shape, and a top plate at the closed end of the U-shape, said aperture being disposed in said top plate.

22. The apparatus of claim 21 further having a cylindrical sleeve disposed in said aperture in said top plate to receive said threaded rod in said sleeve in free rotation.

23. The apparatus of claim 18 wherein said first stop member has a first locking aperture spaced apart from said threaded aperture;

said second stop member having a second locking aperture spaced apart from said key aperture; and said stop member locking means includes a locking insert member adapted to pass through said first and second locking apertures to lock said first and second stop members together, said locking insert having a top flange and an opposite deformable locking ridge, said deformable locking ridge and said top flange both being larger than said first and second locking apertures to maintain the locking insert within said apertures.

* * * * *